United States Patent [19]

Truglio

[11] Patent Number: 4,600,335

[45] Date of Patent: Jul. 15, 1986

[54] VEHICLE ACCESS CONTROL DEVICE

[76] Inventor: Ralph Truglio, 107 W. Baldwin St., Hackettstown, N.J. 07840

[21] Appl. No.: 578,663

[22] Filed: Feb. 9, 1984

[51] Int. Cl.[4] ..... E01F 13/00

[52] U.S. Cl. ..... 404/6; 49/49; 49/131

[58] Field of Search ..... 404/6, 10, 11; 49/35, 49/49, 131, 134

[56] References Cited

U.S. PATENT DOCUMENTS

| | | | |
|---|---|---|---|
| 1,694,128 | 12/1928 | Lockett | 49/134 |
| 2,356,559 | 8/1944 | Banschbach | 49/49 |
| 2,883,780 | 4/1959 | Goodman | 49/35 |
| 3,049,062 | 8/1962 | Irwin | 404/6 |
| 3,324,805 | 6/1967 | Mulch | 104/250 |
| 3,325,782 | 6/1967 | Der | 340/935 |
| 3,376,667 | 4/1968 | Parr | 49/49 |
| 4,029,007 | 6/1977 | Levinson | 101/42 |
| 4,367,975 | 1/1983 | Tyers | 404/6 |

*Primary Examiner*—James A. Leppink
*Assistant Examiner*—John F. Letchford

[57] ABSTRACT

A device for stopping selected vehicles in which a hinged pressure plate or ramp is supported by a pivotally mounted barrier plate, which is pivotally linked to the pressure plate and supported by a retractable locking device allowing vehicles to pass over the device.

When a selected vehicle is to be stopped, the locking device is retracted, allowing the weight of the vehicle to depress the pressure plate, thus pivoting the barrier plate from its horizontal position to its barrier position, where it blocks vehicular movement.

1 Claim, 7 Drawing Figures

VEHICLE ACCESS CONTROL DEVICE

This invention relates to vehicle access-barrier systems and more particularly to an improved selectably controllable vehicle responsive access-barrier device for precluding undesired unidirectional motion of a vehicle beyond a predetermined location.

Many different types of devices, both simple and complex, have been and currently are being used to control vehicular access to a given area such as manually placeable sawhorse type barrier units, pivotable gates as found at toll booths and railroad crossings, elevatable road sections as found in draw bridges or the like and elevatable or spring biased spike adapted to selectively engage and/or perforate tires or the like if approached from the wrong direction. Most of such systems are of the type that are normally biased to deny vehicle access and are operable to remove the barrier from the path of vehicle to grant access to a particular location. Such mode of operation usually requires repeated barrier displacement to permit vehicle access and such repeated functioning leads to increased maintenance and repair and to relatively shortened operating life.

The subject invention may be briefly described, in its broader aspects, as a vehicle access control system that includes remotely controllable vehicle actuated barrier device for precluding vehicle access to or from a particular location or area. In its narrower aspects, the invention may be described as including a pivotally mounted and vehicle displaceable pressure member mechanically linked to a barrier plate elevatable in response to vehicle induced downward displacement of said pressure member in association with remotely controllable arming means selectively biasable to either permit or preclude vehicle induced displacement of the pressure member in accord with the exigencies of particular installation thereof.

In the intended operation of the disclosed vehicle access control system, the device will be desirably installed in a road surface at a particular location in the path of vehicular travel, such as at the entrance or exit to parking lots, in unidirectional roads such as exit ramps from express highways, at toll booths or even on airport runways to selectively deny access thereto for military purposes. When so installed, the status of the arming means will control whether the system will operate in its preferred mode of normally permitting unrestricted vehicle travel thereover with only selective denial of access to particular vehicles or to normally denying vehicle travel therepast with accompanying selective permitted passage of vehicles therover.

Among the advantages of the subject invention is the provision of a simple vehicular access control system that is characterized by low maintenance, long operating life and minimal need for repair. Still another advantage is the provision of dual modes of permitted operation which serve to permit a marked reduction in operational cycles for a given period of use with consequent reduced maintenance costs and longer operating life. A still further advantage is the ready adaptation of the system for military purposes such as selective denial of airplane runway usage.

The object of this invention is the provision of an improved vehicle access control system.

A further object of this invention is the provision of an improved selectably controllable, vehicle responsive access-barrier device for precluding undesired unidirectional motion of vehicle beyond a predetermined location.

Still other objects and advantages of the subject invention will become apparent from the following portions of this specification and from the appended drawings which illustrate, in accordance with the mandate of the patent statutes, a presently prepared embodiment of a selectably controllable, vehicle responsive access-barrier device incorporating the principles of this invention.

Figure 1:
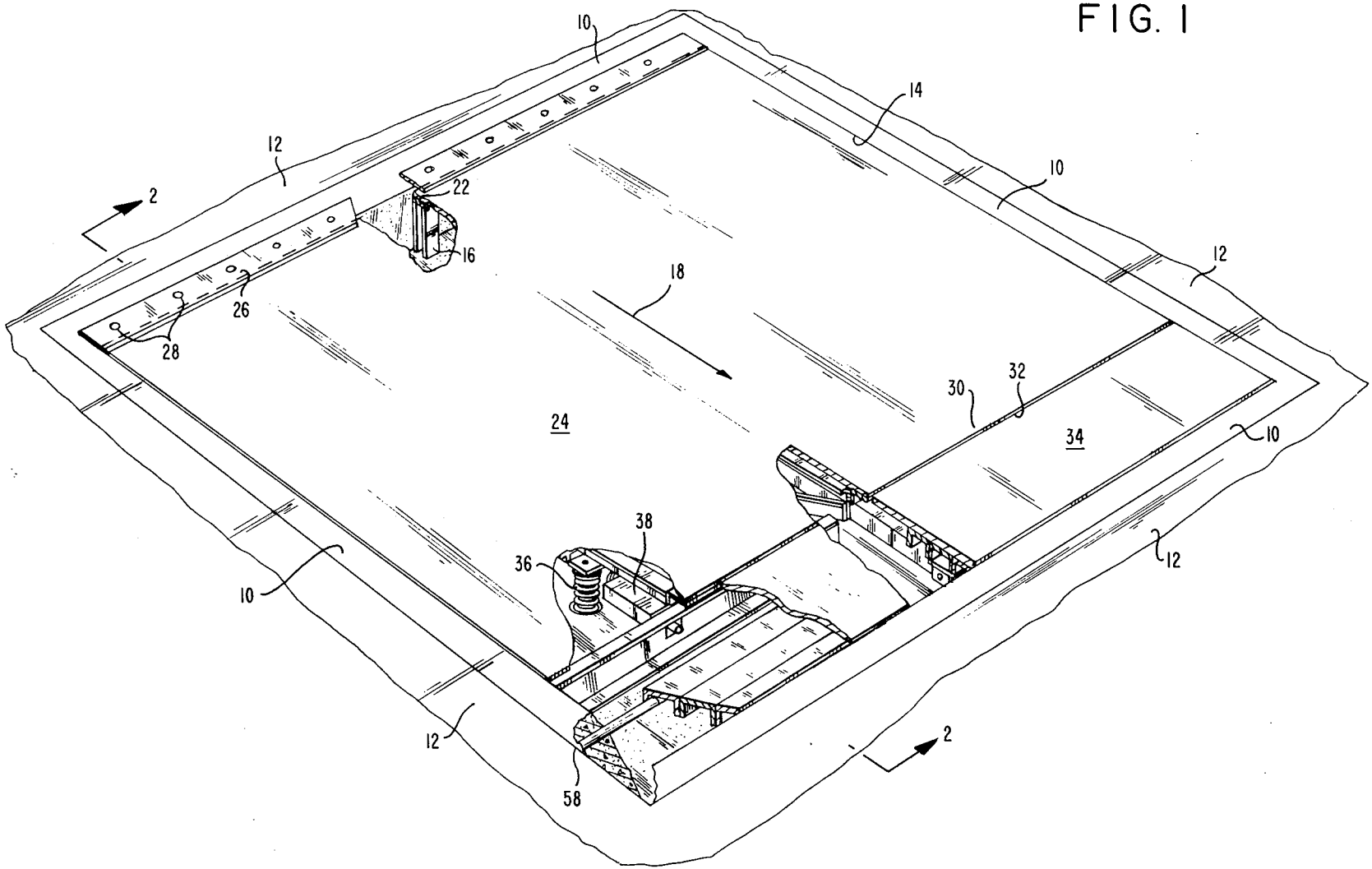
FIG. 1 is an oblique partially cutaway and sectional view of a access-barrier device incorporating the principles of this invention.
Figure 2:
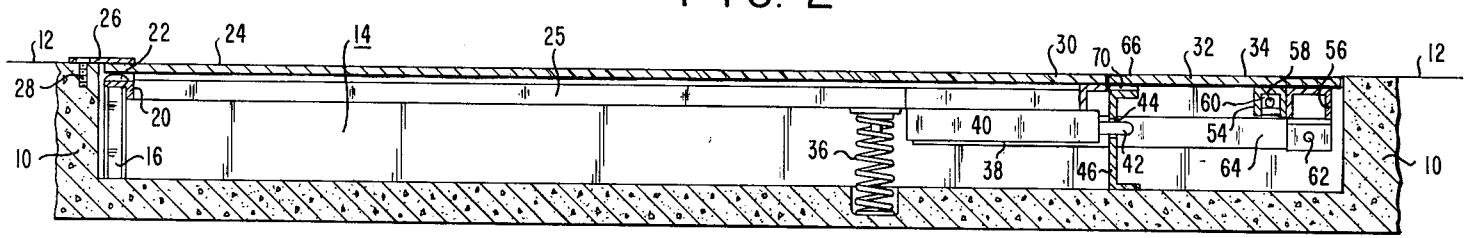
FIG. 2 is a section taken on the line 2—2 of FIG. 1 and showing the device in its "access" mode.
Figure 3:
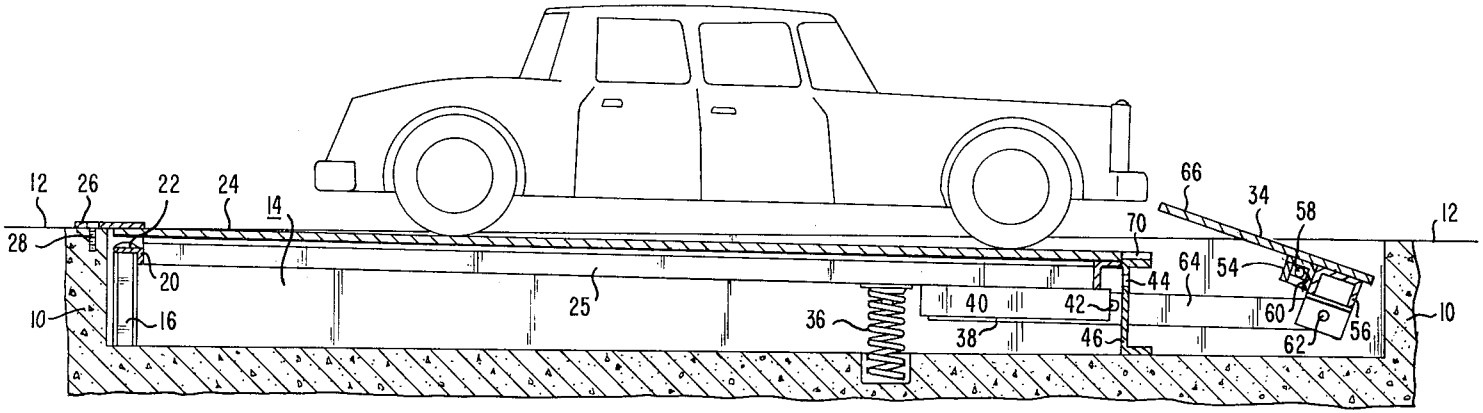
FIG. 3 is a section as shown in FIG. 2 and showing the device in its barrier mode and as actuated by the weight of an automobile.
Figure 4:
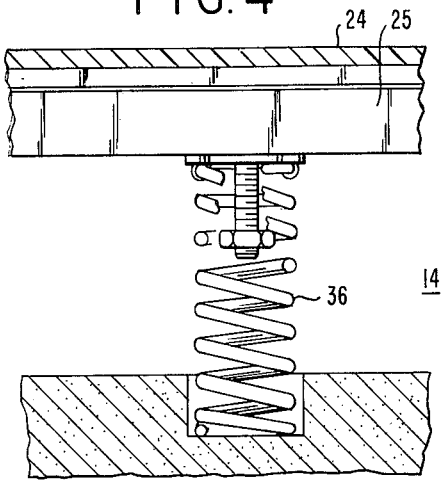
FIG. 4 is a enlarged sectional view, partially cutaway to more clearly show the detail of the pressure plate spring baising means and adjustable stop.
Figure 5:
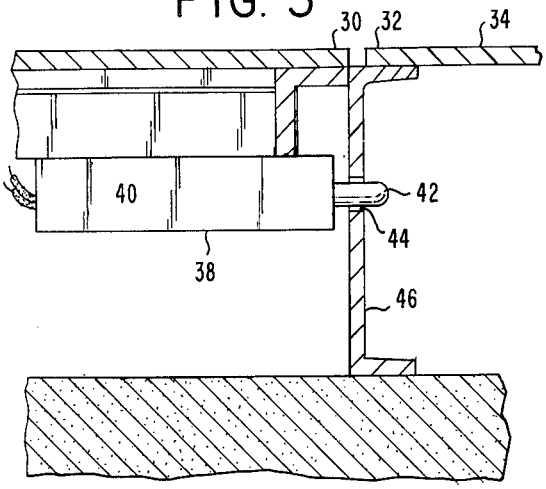
FIG. 5 is an enlarged sectional view, to more clearly show the detail of the mode control means.
Figure 6:
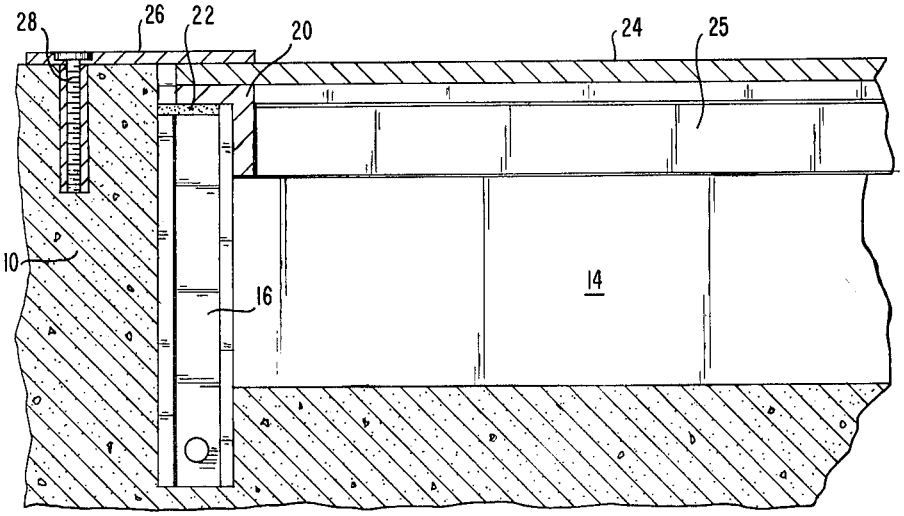
FIG. 6 is an enlarged sectional view, to more clearly show mounting support for the upstream end of the pressure plate.

Referring to the drawings, and initially to FIGS. 1–3, the improved access-barrier device includes a rectangular box-like perimetric frame, generally designated 10, which may be prefabricated out of metal or formed of cast concrete, either remotely or at the locus of use thereof. As clearly shown, the frame 10 is generally definitive of a box like receptacle 14 adapted to be recessed in a road surface 12 with the upper open end thereof being disposed substantially coplanar with the road surface. The normal direction of vehicle traffic is indicated by the arrow 18 in FIG. 1.

Disposed within the receptable 14 and abutting relation to the upstream wall thereof are a plurality of vertical columns 16 such as I beam sections or the like supporting a transverse beam member 20, suitably an angle iron extending across the receptacle 14 and, having its upper surface located a predetermined distance below the road surface. Mounted on the upper surface of the transverse beam member 20 is a bearing pad 22, suitably Telfon or the like, which portion supports the upstream marginal end portion of a pressure plate member 24 and serves as a pivotal mounting therefore. The pressure plate member 24 is sized to provide a continuation of the road surface and extends across the full width of the receptacle 14 and over the greater portion of the length thereof in the direction of vehicle advance. The pressure plate member 24 is of sufficient strength to support the types of vehicle that will pass thereover and to this end may include underlying longitudinal beam members 25. The joint intermediate the upstream end of the pressure plate member 24 and the adjacent transverse marginal wall of the frame 10 is covered by a thin tread plate 26 fastened to the frame 10 by security screws 28 or the like to deter, if not preclude, unauthorized removal thereof.

The downstream end 30 of the pressure plate 24 is disposed in abutting relation with the upstream end 32 of a displaceable barrier plate 34; with the latter being of sufficient transverse extent to also span the receptable 14. The downstream end 30 the pressure plate 24 is normally biased into coplanar relation with the road surface by one or more compression springs 36 and is lockable in such elevated position by a remotely operable locking assembly, generally designated 38. Included in such locking assembly are one or more simultaneously acting solenoids 40, the extending pin armature 42 thereof being insertable into appropriately located aperture 44 in a U shaped transverse cross beam 46 disposed in abutting and slightly spaced relation from the downstream end of the pressure plate member 24. Alternatively, the solenoids 40 may be mounted on said cross beam 46 with their extending pins 42 protruding into the path of the pressure plate member 24. In the preferred mode of operation, the solenoids 40 are normally unactivated and the pin armature 42 are spring biased into advanced position within the apertures 44 thus providing a positive support for the downstream end of the pressure plate member 24 and the maintanence thereof in essentially coplanar relation with the road surface during vehicular traffic thereover.

Figure 7:
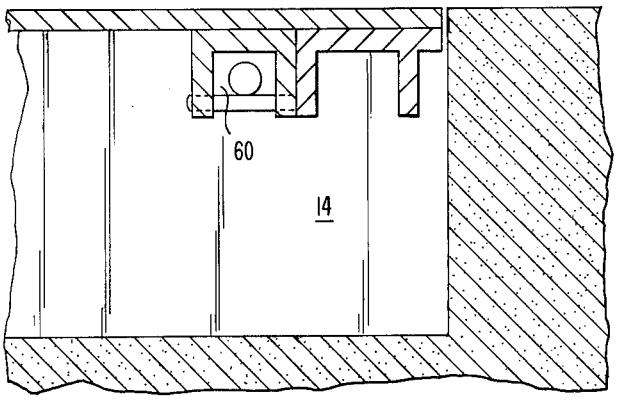
FIG. 7 is an enlarged sectional view, to more clearly show the mounting of the barrier plate member.

As best shown in FIGS. 2, 3 and 7, the barrier plate 34 is structionally reinforced by a pair of transverse and generally U shaped channel members 54, 56 in order to insure the passage of vehicular traffic thereover when such barrier plate is disposed essentially coplanar with the pressure plate 24 and the road surface 12. The barrier plate 34 is pivotally mounted in the vicinity of its midlength on transverse shaft 58, which may extend across the receptacle or may be constituted by a pair of frame supported stub shaft. Such mounting may include a transverse web plate 60 and suitable antifriction bearings, not shown, to facititate pivotal displacement of the barrier plate about the shaft. The downstream end of the barrier plate 34 is connected through pivotal mounting 62 and link 64 to the downstream end 30 of the pressure plate member 24 in such manner that downward displacement of the downstream end 30 of pressure plate 24 results in a concomitant downward displacement of the downstream end of the barrier plate 34 end a pivotal displacement of the latter about shaft 58 with a consequent elevation of the upstream end thereof to the vehicle arresting position illustrated in FIG. 3, wherein the barrier plate 34 is disposed at a barrier elevation, suitably between 30° and 60°.

In a similar manner, elevation of the downstream end 30 of the pressure plate 24 under action of the spring 36 results, through link 64 and pivotal mounting 62, in a rotation return of the barrier plate 34 to its horizontal position in coplanar relation with the road surface 12 and the elevated pressure plate 24.

Desirably the upstream end 66 of the barrier plate 34 is supported by the upper extending flanges 68 of cross beam 46 in substantially horizontal coplanar relation with the pressure plate 24 and road surface 12. In a preferred construction, a cushioning strip 70 of rubber or rubber like material is interposed intermediate said flanges 68 and the underside of the upstream end of the barrier plate 34 to cushion impact therebetween and to deaden contact noise therebetween.

As previously pointed out the described system is capable of two distinct modes of operation without any serious structural modification thereof.

In the presently preferred mode of operation, the pressure plate member 24 will be normally locked in its horizontal position and substantially coplanar with the road surface by the disposition of the extended pin members 42 within the apertures 44 in the crossbeam 46. When the pressure plate member 24 is so positioned, the barrier plate 34 will be likewise located in its horizontal position forming an extension of the road surface. As previously described, in such preferred mode of operation the solenoid 40 is most desirably in its deactivated condition and the pin members 42 are spring-biased into their advanced and locked position within the apertures 44. Under such conditions, the system is effectively unarmed and successive vehicles may pass thereover without actuation of the barrier. If, however, under such conditions the solenoid 40 is actuated, as through a remote control device, the pins 42 will be retracted out of engagement with the apertures 44 and the pressure plate 24 will then be normally supported in its horizontal position solely by the action of the spring member 36. Under such armed condition, advance of a vehicle thereover will result, because of the vehicle weight, in a pivotal displacement of the pressure plate 24 and a concomitant downward displacement of the downstream end 30 thereof relative to the horizontal. Such downward displacement of the downstream end 30 of the pressure plate 24 will result, through link 64 and pivotal mounting 62, in a simultaneous rotational displacement of the barrier plate member 34 about the transverse shaft means 58 and in a concomitant elevation of the upstream end 66 into vehicle arresting position as generally illustrated in FIG. 3. With the barrier plate member 34 so elevated further vehicle advance is and will be precluded, unless and until the vehicle is moved in the reverse direction out of engagement with the pressure plate 24 and the solenoid 40 deactivated to permit reintroduction of pins 42 into locking relation within the apertures 44. As will now be apparent, such preferred mode of operation normally operates to permit vehicle passage therepast and to preclude vehicle passage only upon activation of the solenoid 40.

In the secondary mode of operation, the pins 42 will be normally spring biased into retracted position out of engagement with the apertures 44 in the crossbeam 46 when the solenoid 40 is in deactivated condition. Under such conditions, both the pressure plate 24 and barrier plate 34 will be normally disposed in the horizontal position forming a continuation of the road surface 12 through the biasing action of the spring 36. However, in this mode of operation, advance of a vehicle onto the pressure plate 24 will result in depression of the downstream end 30 thereof, and concomitant elevation of the upstream end 66 the barrier plate 34 in the manner described above. In this secondary mode of operation, deactivation of the system to permit unimpeded vehicle passage therepast will be effected by selective actuation of the solenoid 40 to effect introduction of the pins 42 into locking relation within apertures 44 against the action of the biasing springs associated therewith. In this secondary mode of operation, vehicle access and or passage therepast will normally be precluded unless the system is effectively actuated by arming of the solenoid.

While the specifically disclosed preferred embodiment relates to a system for controlling the advance of wheeled vehicles such as automobiles, it will be apparent that installation of the unit in a location such as in airport runways could readily be employed to selectively deny access thereto landing aircraft and, in fact, to effect destruction of any plane attempting to land.

As will also be apparent, the described system can be of a width or transverse dimension sufficient to accommodate the entire width of a vehicle or could be compositely constituted of one or more units of lesser width each sized to accommodate a defined wheel track or the like.

In addition to the foregoing it should now be apparent to those skilled in this art that while the specifically illustrated and described apparatus is adapted to preclude unidirectional vehicle advance, the mounting of two such units in back-to-back relation would effectively constitute a vehicle isolating system which would operate when properly armed to halt vehicle advance in one direction in the manner described and to likewise preclude vehicle return in the opposite direction, thus effectively immobilizing a vehicle when so desired.

Having thus described my invention, I claim:

1. A device for blocking vehicle movement along a road surface from a direction upstream to downstream comprising a pressure plate pivotally mounted in coplanar relation with the road surface at its upstream end having a downstream end vertically displaceable in a downward direction below the road surface, in response to vehicle weight thereon, spring means normally biasing the downstream end of said pressure plate in coplanar relation with said road surface, a pivotally mounted barrier plate normally biased in coplanar relation with said road surface having its upstream end disposed in abutting relation with the downstream end of said pressure plate and a downstream end disposed remote therefrom and normally coplanar with the road surface, means for precluding downward displacement of said upstream end of said barrier plate below the level of said road surface, means pivotally mounting said barrier plate intermediate its upstream and downstream ends for normally biasing said plate in coplanar relation with said road surface and to permit its displacement from its normally biased first position coplanar with said road surface to a second position wherein said upstream end thereof is elevated into vehicle engaging relation above said road surface, and its downstream end is displaced downwardly below the road surface, linkage means mechanically interconnecting the downstream end of said pressure plate with said barrier plate intermediate said pivotal mounting means and the upstream end thereof to effect pivotal displacement of the barrier plate from its first to its second position in response to downward displacement of the downstream end of said pressure plate, and selectively actuatable means for preventing downward displacement of said downstream end of said pressure plate in response to vehicle weight thereon to preclude undesired elevation of said barrier plate.

* * * * *